US007694834B2

(12) United States Patent
Wolf et al.

(10) Patent No.: US 7,694,834 B2
(45) Date of Patent: Apr. 13, 2010

(54) ELECTRO-MECHANICAL COUPLER FOR USE WITH MODEL TRAINS

(75) Inventors: Michael P. Wolf, Highland, MD (US); David L. Krebiehl, Saint Joseph, MI (US); Scott B. Long, Beaverton, OR (US)

(73) Assignee: Mike's Train House Inc., St. Joseph's, MI (US)

( * ) Notice: Subject to any disclaimer, the term of this patent is extended or adjusted under 35 U.S.C. 154(b) by 52 days.

(21) Appl. No.: 11/826,380

(22) Filed: Jul. 13, 2007

(65) Prior Publication Data

US 2009/0014402 A1 Jan. 15, 2009

(51) Int. Cl.
*B61G 7/04* (2006.01)

(52) U.S. Cl. ..... 213/75 TC; 213/75 R

(58) Field of Classification Search ..... 213/75 R, 213/75 TC, 86, 100 R, 100–130, 98, 118
See application file for complete search history.

(56) References Cited

U.S. PATENT DOCUMENTS

| | | | | |
|---|---|---|---|---|
| 3,408,769 | A | 11/1968 | Max | |
| 3,518,790 | A | 7/1970 | Zamarra | |
| 3,605,332 | A | 9/1971 | Stepek | |
| 3,662,489 | A | 5/1972 | Terrier | |
| 3,822,501 | A | 7/1974 | Ade | |
| 3,840,127 | A | 10/1974 | Edwards et al. | |
| 3,850,310 | A | 11/1974 | Osthall | |
| 3,884,360 | A | 5/1975 | Ernst | |
| 3,939,989 | A * | 2/1976 | Thomson | 213/75 TC |
| 4,098,411 | A | 7/1978 | Rossler | |
| 4,195,742 | A | 4/1980 | Yumoto | |
| 4,335,820 | A | 6/1982 | Gramera | |
| 4,512,483 | A | 4/1985 | Crossley et al. | |
| 4,650,081 | A | 3/1987 | Diller | |
| 4,700,855 | A | 10/1987 | Boeniger | |
| 4,765,496 | A | 8/1988 | Diller | |

(Continued)

FOREIGN PATENT DOCUMENTS

| | | |
|---|---|---|
| EP | 0609516 | 8/1994 |

OTHER PUBLICATIONS

"3 How-to Stories Build better trees," Model Railroader, Backmann 4-4-0 reviewed, Jul. 2007.

(Continued)

*Primary Examiner*—S. Joseph Morano
*Assistant Examiner*—Jason C Smith
(74) *Attorney, Agent, or Firm*—McDermott Will & Emery LLP

(57) ABSTRACT

A coupler for use with model trains. The coupler includes a body member; a knuckle pivotally mounted on the body member, where the knuckle is in either an open state or a closed state; a locking pin disposed on the body member, where the locking pin is operable for maintaining the knuckle in the closed state when the locking pin is in a first position, and for allowing the knuckle to transition to the open state when the locking pin is in a second position; and an actuator wire coupled to the body member and the locking pin. In operation, the actuator wire contracts in length when an electrical signal is supplied thereto such that the locking pin is transitioned to the second position when said electrical signal is supplied to the actuator wire.

22 Claims, 7 Drawing Sheets

U.S. PATENT DOCUMENTS

| | | | | | |
|---|---|---|---|---|---|
| 4,768,663 | A | | 9/1988 | Schuller | |
| 4,893,716 | A | | 1/1990 | Diller | |
| 5,316,158 | A | * | 5/1994 | Dunham et al. | 213/75 TC |
| 5,423,439 | A | * | 6/1995 | Richter | 213/75 TC |
| 5,509,546 | A | * | 4/1996 | Staat | 213/75 TC |
| 5,620,106 | A | | 4/1997 | Storzek | |
| 5,662,229 | A | * | 9/1997 | Edwards | 213/75 TC |
| 5,678,789 | A | | 10/1997 | Pipich | |
| 5,681,202 | A | | 10/1997 | Sander | |
| 5,775,524 | A | * | 7/1998 | Dunham | 213/75 TC |
| 5,785,192 | A | * | 7/1998 | Dunham et al. | 213/75 TC |
| 5,823,371 | A | * | 10/1998 | Riley et al. | 213/75 TC |
| 5,826,736 | A | * | 10/1998 | Weber | 213/75 A |
| 5,931,322 | A | * | 8/1999 | Storzek | 213/75 TC |
| 6,095,351 | A | | 8/2000 | Roessler | |
| 6,189,713 | B1 | * | 2/2001 | Oh | 213/75 TC |
| 6,308,845 | B1 | * | 10/2001 | Sergent, IV | 213/75 TC |
| 6,604,641 | B2 | | 8/2003 | Wolf et al. | |
| RE38,990 | E | * | 2/2006 | Staat | 213/75 TC |
| 6,994,224 | B2 | * | 2/2006 | Barger et al. | 213/75 TC |
| 2005/0167386 | A1 | * | 8/2005 | Barger et al. | 213/75 TC |
| 2006/0102579 | A1 | * | 5/2006 | Weaver et al. | 213/75 TC |
| 2007/0084818 | A1 | * | 4/2007 | Brabb et al. | 213/100 R |
| 2008/0271470 | A1 | * | 11/2008 | Cheetham et al. | 62/156 |
| 2009/0014402 | A1 | * | 1/2009 | Wolf et al. | 213/75 TC |

OTHER PUBLICATIONS

"Coupler Pocket—HO Scale," Recommended Practices, National Model Railroad Association, pp. 1-2, Aug. 1957.
"Solid Couplers," Recommended Practices, National Model Railroad Association, pp. 1-2, Feb. 1960.
"Coupler Contour," Recommended Practices, National Model Railroad Association, pp. 1-2, Aug. 1957.
"X2F Coupler," Data Sheet, National Model Railroad Association, HO Coupler Committee, pp. 1-5, Oct. 1956.
Prudhomme, D.J., "Automatic Coupler," Railroad Model Craftsman, pp. 6-8, Jul. 1951.
Logan, Jack, "Automatic Couplers," Railroad Model Craftsman, pp. 26-28, May 1958.
Semichy, Robert L., "Working couplers up front," Model Railroader, pp. 38-40, Nov. 1966.
Odegard, Gordon, et al., "Basic Model Railroading Couplers," Model Railroader, pp. 38-41, Dec. 1967.
Russell, Harold W., Jr., "Magnetic couplers for 0 scale: 1," Model Railroader, pp. 62-65, May 1972.
Kelly, Jim, et al., "Kadee Couplers," Model Railroader, pp. 78-82, May 1981.
Bronsky, Eric, "HO Tomlinson Couplers that really work," Model Railroader, pp. 80-82, Aug. 1984.
Grams, John A., "Carly Rydin and the Lionel knuckle coupler," Classic Toy Trains for the Collector and Operator, pp. 36-40, Oct. 1990.
Hediger, Jim, "Kadee HO couplers An introduction to Magne-Matic automatic knuckle couplers," Model Railroader, pp. 74-75, Feb. 1995.
Hediger, Jim, "New HO knuckle couplers feature integral springs and easy installation," Model Railroader, pp. 36-37, Feb. 1996.
Ames, Stan et al., "Digital Command Control the comprehensive guide to DCC," The National Model Railroad Association, All tom Hobby, pp. 79-80, 1995.
West, Ross, "Magnetic Couplers," Mainline Modeler, pp. 46-49, Nov. 1998.
Plummer, Ray L., "Getting a Grip Lionel knuckle couplers," Classic Toy Trains fro the Collector and Operator, pp. 90-94, Feb. 1998.
Hediger, Jim, "HO scale magnetic knuckle couplers," Model Railroader, pp. 58-61, Jul. 2000.
Hundman, Robert L., "Sergent Couplers Operating HO Scale Couplers," Mainline Modeler, p. 73, Apr. 2000.
Davis, Dave, "Couplers, Scale or Operating? Something New for Your "Want List"," Railmodel Journal, pp. 9-12, Mar. 2000.
"HO Scale Operating Couplers," Railmodel Journal, pp. 6-7, Apr. 2000.
Wilson, Jeff, "Basics of uncoupling," Model Railroader, pp. 46-48, Jul. 2003.
Teal, Dick, "TMCC rolling stock a flashing rear light and a command-control coupler are an upgrade away," Classic Toy Trains, pp. 56-57, Oct. 2003.
"McHenry scale-size HO magnetic coupler," Model Railroader, pp. 18-19, Jun. 2003.
"HO DCC-controlled couplers," Model Railroader, pp. 22-24, Oct. 2003.

* cited by examiner

ELECTRO-MECHANICAL COUPLER FOR USE WITH MODEL TRAINS

FIELD OF THE INVENTION

The present invention relates to the field of model train couplers, and more specifically, an electromechanical coupler capable of being remotely operated, which allows for a "single-handed" release operation and which is in scale or near scale proportion to the model train the coupler is being utilized in.

BACKGROUND OF THE INVENTION

Model electric trains are well known and have been in existence for over 100 years. Typically, the model electric train systems are scale or near-scale proportioned models intended to simulate real world trains in a miniature form. As is also well known, there are a variety of sizes or "scales" of model trains commonly found in the marketplace, for example, O-gauge, HO-gauge, N-gauge, etc. Hobbyists collect and/or operate model trains in elaborate simulations of real-world environments. The modeling of these environments and simulations of real-world operations is one of the foundations of the hobby itself.

One of the significant objectives for most hobbyists is to create as close to the lifelike situation, regarding both look and operation, as possible. An important aspect regarding the operation of model trains is to simulate the act of connecting and disconnecting various train cars or rolling stock from one another. The terms used, in both the real world as well as model railroading, are coupling (i.e., connecting) and uncoupling (i.e., disconnecting). As explained further below, this important aspect of model railroading has been accomplished through a wide variety of manual, mechanical, and electrical means.

Generally speaking, the term "operating coupler" refers to a coupler which can be opened or closed by some mechanical or electrical (of combination thereof) means. Opening and closing a coupler is usually accomplished by releasing or latching a "knuckle" member into one of a closed position (in which the knuckle member would engage a knuckle member of an adjacent car thereby connecting the two cars) and an open position (in which the knuckle will not engage the knuckle member of the adjacent car thereby preventing connection of the two cars). Typically, the phrase "releasing the knuckle" refers to placing the knuckle member in the open position, the phrase "latching the knuckle" refers to placing the knuckle member in the closed or coupled position.

There are numerous prior art couplers which are manually operated (i.e., placed in either the opened or closed position). These couplers can be opened by the operator by pressing a given tab or arm on the coupler or in some cases, pressing a device attached to the track that indirectly opens the coupler. In such manually operated couplers, a manual latch mechanism, usually spring loaded, keeps the coupler in the closed position until it is physically opened by the operator by pushing, for example, the aforementioned tab.

Another prior art version of a known coupler is mechanical in nature and provides for an electro-magnet to physically release a latch pin, which functions to maintain the knuckle in the closed position and therefore the connection between the two cars. This type of coupler is a common design in O-gauge model trains and has been available in the market for decades. In this design, an electromagnet is embedded in a section of train track. A coupler can be positioned above the magnet such that when the coil in the track is energized, the resultant magnetic field pulls an armature downward, thus releasing the latch pin. Once the latch pin is released, the cars can be separated from one another. This same design often includes a tab to allow for manual operation by the operator.

Yet another type of operating coupler is referred to as a "coil coupler." In this design, the latch pin is either directly connected to or is integral with a plunger in a solenoid. When the solenoid coil is energized, the plunger is pulled in such a way so as to release the latch holding the coupler closed. In this design, as well as others discussed above, it is common for there to be a spring loaded tension against the knuckle biased toward opening the knuckle. As such, some form of latch pin or other mechanical interference is necessary to hold the coupler in the closed position.

It is clear from the foregoing that there are numerous coupler designs and mechanics that in the end, perform the task of connecting two or more train cars. There are also European style "hook and loop" couplers that do not resemble prototypical couplers found on US railroads. These couplers are considered "operational" in the sense that a mechanical device installed in the track can open them manually as the train car passes over the mechanical device.

All of the known coupler devices suffer from at least one of the following problems and many suffer from both. First, many of the couplers are out of proportion with the given scale in both size and shape. Second, many of the couplers can be opened at only set locations around the track (i.e., a position corresponding to the location of a magnet) and/or require manual operation by the operator to release the coupler. Both of these issues represent significant shortcomings to model train operators, especially in the case of HO-gauge, where precision to both scale and shape of the model train and operation thereof is of significant importance to the model train hobbyist.

As such, there is a need in model train systems for a coupler that solves both of the foregoing problems associated with known prior art couplers.

SUMMARY OF THE INVENTION

In an effort to solve the foregoing needs, one objective of the present invention is to provide a coupler that is scale or near scale with respect to both size and shape and, and which allows for automatic operation of the coupler at substantially any time and any location about the rail system without requiring the operator to physically engage or contact the car being uncoupled. In other words, it is an object of the present invention to provide a coupler capable of remote operation which is substantially in scale in both size and shape so as to allow the operator to remotely control the coupler by, for example, activating a switch.

In a first embodiment, the coupler includes a body member; a knuckle pivotally mounted on the body member, where the knuckle is in either an open state or a closed state; a coupler guide disposed on the body member; and a locking pin disposed on the body member. The locking pin is operable for maintaining the knuckle in the closed state when the locking pin is in a first position, and for allowing the knuckle to transition to the open state when the locking pin is in a second position. Further, when the knuckle is in the open state the coupler guide prevents the knuckle from engaging a knuckle of a second coupler to be uncoupled from the coupler.

In a second embodiment, the coupler includes a body member; a knuckle pivotally mounted on the body member, where the knuckle is in either an open state or a closed state; a locking pin disposed on the body member, where the locking pin is operable for maintaining the knuckle in the closed state when the locking pin is in a first position, and for allowing the knuckle to transition to the open state when the locking pin is in a second position; and an actuator wire coupled to the body member and the locking pin. In operation, the alloy actuator wire contracts in length when an electrical signal is supplied thereto such that the locking pin is transitioned to the second position when said electrical signal is supplied to the actuator wire.

The coupler of the present invention provides important advantages over the prior art couplers. Most importantly, the coupler provides for substantial scale accuracy with regard to both size and shape of the coupler, and allows for remote operation of the coupler at any location of the rail system without requiring manual intervention by the operator (i.e., without requiring the operator to physically engage the car being uncoupled).

Another advantage of the coupler of the present invention is that it allows for single-handed release of the car (i.e., coupler) connected to the coupler. In other words, activation of the coupler of the present invention allows the coupler of the present invention to be unilaterally released from standard prior art couplers, such as for example, Kadee #5 (HO non-scale) or #58 (HO scale) coupler.

Yet another advantage is that the design of the coupler of the present invention provides for reliable operation, while simultaneously being electrically efficient and cost effective.

Additional advantages of the present invention will become apparent to those skilled in the art from the following detailed description of exemplary embodiments of the present invention.

The invention itself, together with further objects and advantages, can be better understood by reference to the following detailed description and the accompanying drawings.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein: rather, these embodiments are provided so that this disclosure will be thorough and complete, and will fully convey the scope of the invention to those skilled in the art; like numbers refer to like elements throughout.

Figure 1A:
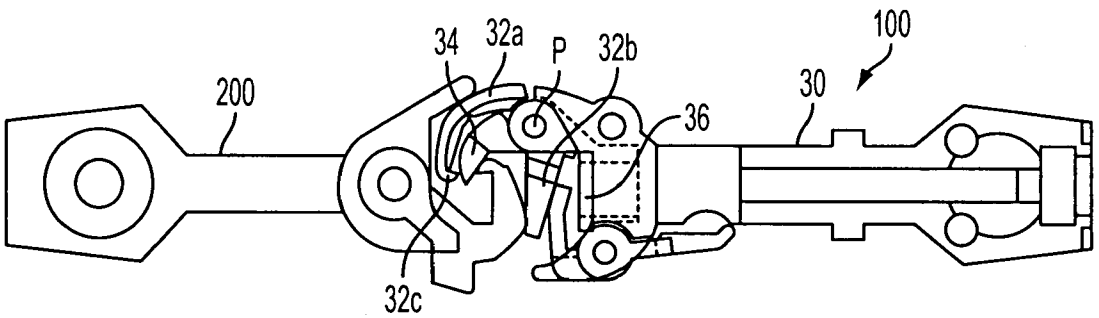
FIG. 1*a* illustrates a first exemplary embodiment of the coupler 100 of the present invention in the open state.
Figure 1B:
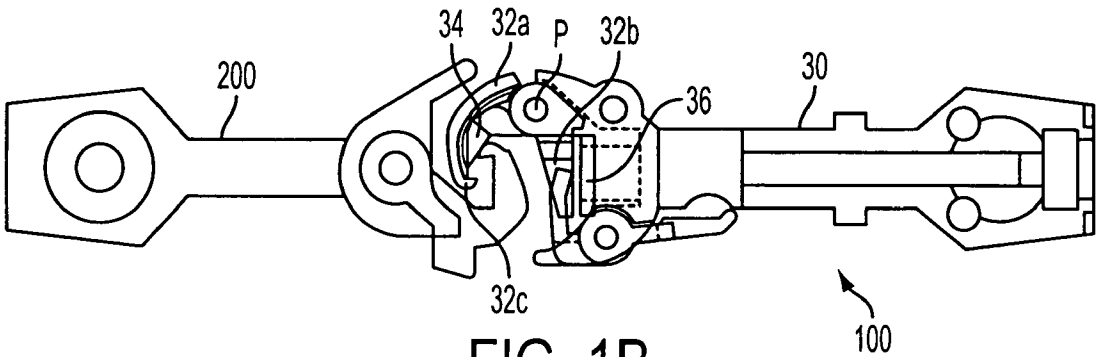
FIG. 1*b* illustrates the first exemplary embodiment of the coupler 100 of the present invention in the closed state.

FIGS. 1*a* and 1*b* illustrate a first exemplary embodiment of the coupler 100 of the present invention. FIG. 1*a* illustrates the coupler 100 in the open position, while FIG. 1*b* illustrates the coupler 100 in the closed position. It is noted that FIGS. 1*a* and 1*b* also illustrate a prior art coupler member 200 so as illustrate how the coupler 100 connects and releases from a standard coupler member 200.

Figure 2A:
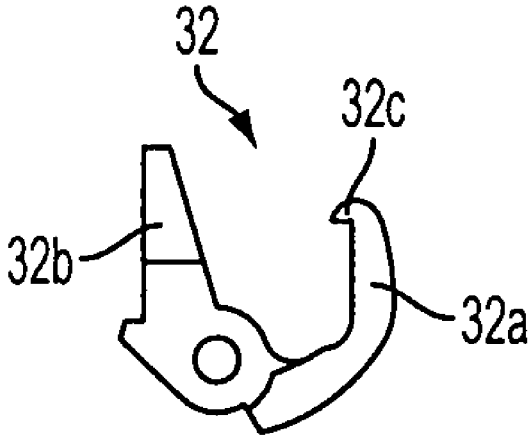
FIGS. 2*a* and 2*b* illustrate an exemplary embodiment of the knuckle contained in the coupler illustrated in FIGS. 1*a* and 1*b*.
Figure 2B:
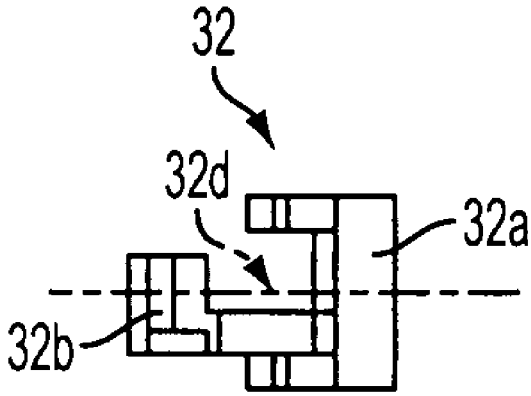

Referring to FIG. 1*a*, the coupler 100 includes a body member 30, which as explained in detail below, has an inner opening for receiving a shape memory alloy actuator wire which controls the opening and closing of the coupler 100; a knuckle 32 which is pivotally mounted on the body member 30; a coupler guide 34; and a locking pin 36. The knuckle 32, which as shown in FIGS. 2*a* and 2*b*, has a substantial C-shaped configuration and has an arm section 32*a* and a base section 32*b* which engages the locking pin 36 when the knuckle 32 is in the closed position. The arm section 32*a* of the knuckle includes a latch member 32*c*, which is positioned substantially perpendicularly to the surface of the arm member 32*a*. The latch member 32*c* functions to engage the knuckle member of the opposing coupler to maintain connection between the couplers in the closed state as shown in FIG. 1*b*. As noted, the knuckle 32 is pivotally mounted to the body member 30 at point P as shown in FIGS. 1*a* and FIG. 1*b*.

In the given embodiment, the knuckle 32 also includes an opening or slot 32*d* which allows the knuckle 32 to move relative to coupler guide 34, which is fixed to the body member 30. In other words, referring to FIGS. 1*a* and 1*b*, the knuckle 32 moves relative to the coupler guide 34 such that in the closed position as shown in FIG. 1*b*, the knuckle 32 substantially fits over the coupler guide 34. As shown in FIG. 1*b*, in this position, the latch member 32*c* extends beyond the end of the coupler guide 34. As such, the latch member 32*c* is capable of engaging a corresponding latch member disposed on coupler member 200, thereby preventing the two couplers from decoupling from one another. However, when the coupler 100 is in the open position as shown in FIG. 1*a*, the knuckle 32 is pulled back relative to the coupler guide 34 such that the latch member 32*c* of the knuckle 32 cannot engage or contact the corresponding latch member on coupler 200. As a result, with the knuckle 32 in the open position, the two couplers readily disengage (i.e., also referred to as decouple and/or uncouple) from one another.

As is clear from the foregoing and FIGS. 1*a* and 1*b*, when the knuckle 32 is in the open position, the coupler guide 34 functions as a ramp which guides the latch member of the opposing coupler away from the latch member 32*c*, thereby preventing the latch members from engaging one another and ensuring that the two couplers will uncouple from one another. As such, it is important for proper operation that the rotation of the knuckle 32 relative to the coupler guide 34 be such that the opposing latch member only contacts the coupler guide 34 when the knuckle 32 is in the open position. It is noted that while in the given embodiment, the design of the knuckle 32 is such that the knuckle 32 straddles the coupler guide 34, it is also possible to position the coupler guide 34 adjacent the knuckle (either above or below) so that the coupler guide 34 and the knuckle 32 are side-by-side.

As will be explained in further detail below, the locking pin 36 is spring-biased so as to urge the locking pin 36 into the closed position in which the knuckle 32 is closed. When positioned in the closed state, referring to FIG. 1*b*, the locking pin 36 engages a portion of the base section 32*b* of the knuckle 32 so as to prevent the knuckle 32 from rotating, thereby maintaining the knuckle in the closed position. In order to transition the knuckle to the open state, the locking pin 36 is pulled down away from knuckle 32 such that the locking pin 36 no longer engages the base section 32*b* of the knuckle 32. Once this occurs, the knuckle 32 rotates outwardly by force of spring tension as shown in FIG. 1*a* so as to place the knuckle 32 in the open position. As explained in more detail below, the locking pin 36 can be activated (i.e., pulled back so as to release the knuckle from the closed position) by an electronic means or by manual means. As explained in more detail below, the locking pin 36 can be activated (i.e., pulled back so as to release the knuckle from the closed position) by an electronic means or by manual means. It is noted that once the knuckle is opened, the knuckle remains in open position until it is physically rotated back to the closed position at which time the spring associated with the locking pin 36 forces the locking pin 36 to the closed state. More specifically, there is a radius at the base section 32*b* of the knuckle that effectively pushes back the locking pin 36 by cam action until the locking pin 36 clears the cam radius at which time, the locking pin 36 snaps back to the fully extended position thus locking the knuckle in the closed position.

Figure 3:
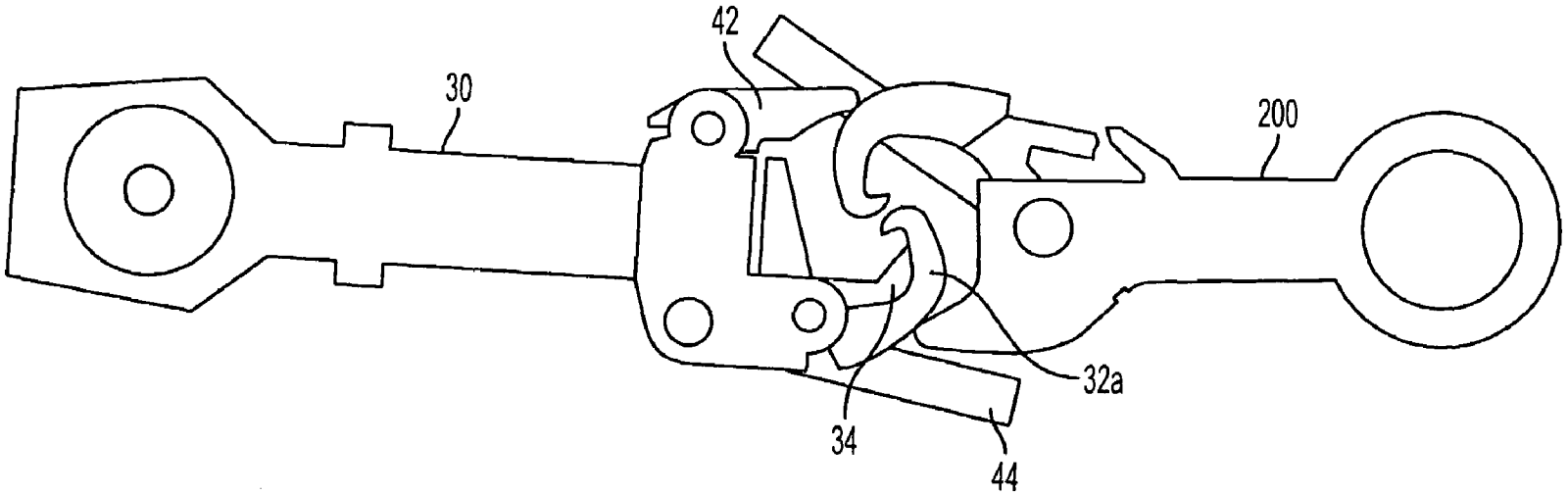
FIG. 3 illustrates a variation of the embodiment of the present invention illustrated in FIGS. 1*a* and 1*b*.

FIG. 3 illustrates a variation of the foregoing embodiment of the present invention. Specifically, FIG. 3 illustrates this variation of the coupler 110 engaged with a prior art coupler 200. As with the first embodiment, the coupler 110 includes a body member 30; a knuckle 32; a coupler guide 34; and a locking pin 36 configured in the same manner as discussed above. In addition, the coupler 110 includes a knuckle stop member 42 and a release member 44. The knuckle stop member 42 is pivotally mounted to the body member 30 and is spring biased such that the knuckle stop member 42 is continually forced inward in the direction of the throat area of the knuckle 32. In operation, the knuckle stop member 42 functions to engage the knuckle of the opposing coupler when the two couplers first make contact. Specifically, when the two couplers first engage one another, the opposing knuckles engage one another, which causes a lateral displacement of the prior art coupler as it slides along the outer surface of the arm section 32*a* of the knuckle 32. During this motion, the prior art knuckle engages the knuckle stop member 42, which is initially pivoted outwardly against its spring-loaded tension by the prior art knuckle. However, once the prior art knuckle clears the arm section 32*a* of the knuckle 32, the prior art knuckle is forced into the throat area of the knuckle 32 by the spring-loaded tension of the knuckle stop member 42. As such, the knuckle stop member 42 functions to ensure that the opposing knuckle is properly received during the coupling process, thereby ensuring proper coupling.

Figure 4:
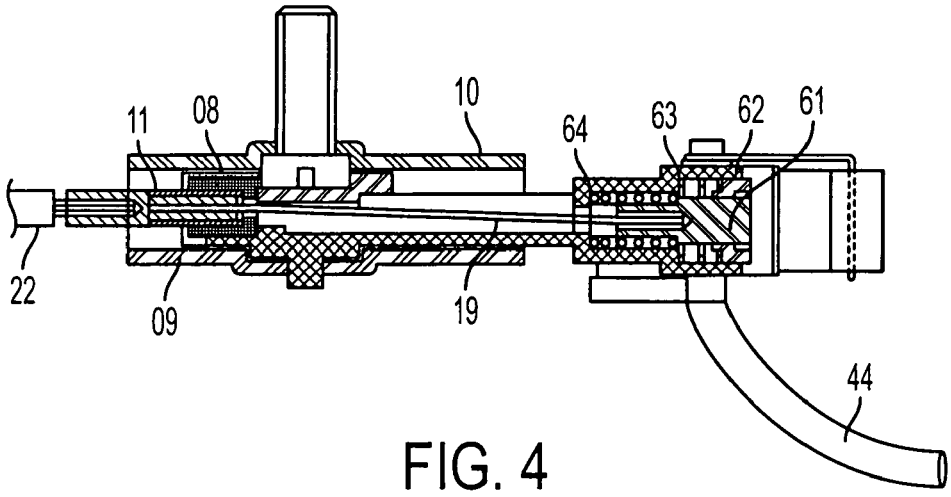
FIG. 4 is a cross-sectional view of the structural configuration of the coupler 100 shown in FIG. 1*a*.
Figure 5:
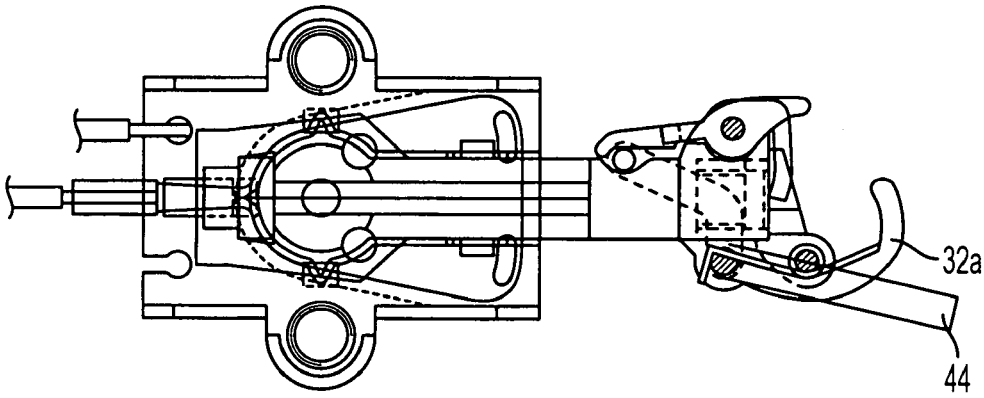
FIG. 5 is a top-down sectional view of the structural configuration of the coupler 100 shown in FIG. 4.

FIG. 4 illustrates the structural configuration of the coupler 100 shown in FIG. 1*a* in more detail and includes the electrical elements of the coupler 100 which allow the coupler to be placed into the open position by having the operator activate a single switch, thereby allowing the coupler 100 to be opened at any position around the rail system. Referring to FIG. 4, which is a cross-sectional view of the coupler 100, the body member 30, which includes a top cover 10 and a bottom cover 9, has disposed therein a tubular member 11, which can be formed for example, from brass. The tubular member 11 operates to receive and secure a lead wire 22 on one end of the tubular member 11 and memory actuator wire 19 on the other end of the tubular member 11. The lead wire 22 and memory actuator wire 19 are electrically coupled to one another via the tubular member 11. In one embodiment, the tubular member 11 may be crimped so as to secure both the lead wire 22 and the memory actuator wire 19. The tubular member 11 is fixed within the body member 30 and does not move within the body member 30. An insulating member 8 is placed around the tubular member 11 and functions to electrically isolate the tubular member 11 from the other components of the coupler 100. This is necessary so that the electrical signal delivered to the memory actuator wire 19 via the lead wire 22 traverses the memory actuator wire 19 and is not immediately coupled to ground via the body member 30 of the coupler 100.

The other end of the memory actuator wire 19 is connected to the locking pin 36. In operation, when an electric pulse of the appropriate magnitude is applied to the memory actuator wire 19, the length of the wire 19 physically shortens. As the memory actuator wire 19 is connected to the locking pin 36, when the memory actuator wire 19 shortens in response to the electric signal, the locking pin 19 is pulled back away from the base section 32*b* of the knuckle 32, thereby allowing the knuckle 32 to transition to the open position. As noted above, when the knuckle 32 is in the open position, the coupler 100 will release the opposing coupler to which it was connected. Thus, the coupler 100 allows for single-handed release (only coupler 100 needs to be placed in the open position to allow separation of the two couplers).

As noted, the coupler 100 utilizes a shape memory alloy actuator wire 19 in the design. A specific brand of this wire is called Flexinol® and is manufactured by Dynalloy, Inc. Flexinol®, or "muscle wire" as it is commonly referred to, uses thermal contraction properties that occur naturally when electrical current is applied. Made of nickel-titanium these small diameter wires contract like muscles when electrically driven. This ability to flex or shorten is a characteristic of certain alloys that dynamically change their internal structure at certain temperatures. The alloy wires contract by several percent of their length when heated and can then be easily stretched out again as the wires cool back to room temperature. Both heating and cooling can occur quite quickly. It is noted that any other wire exhibiting the same properties may also be utilized.

The properties of the "muscle" wire make it ideal for remote electrical actuation of couplers. Further, as the wires are available with diameters as small as 0.001", it is possible to integrate the wire into coupler designs while maintaining scale proportions. In the given embodiment, the shape memory actuator wire 19 is approximately 1 cm long, and as noted above is attached to the locking pin 36 on one end and secured to a tubular member 11 at the other end. The lead wire 22 allows for application of a current and/or voltage signal to the memory actuator wire 19. Completion of the electrical circuit occurs through the die-cast metal coupler arm via the locking pin 36. As noted above, when the electrical signal is applied, the memory actuator wire 19 contracts thus pulling the locking pin 36 and releasing the spring loaded knuckle 32, thereby placing the knuckle 32 in the open position.

In an alternative embodiment, the length of memory actuator wire is made slightly more than twice the length of the memory actuator wire 19 in the foregoing embodiment, and the memory actuator wire is formed into a "U" shape where connected to the locking pin 36. In this design, electrical current can be applied via two separate wires attached to either end of the memory actuator wire 19. The benefit of this embodiment is it provides for twice the pulling force for the same amount of energy input. In other words, the pulling force is doubled by having two wires pulling the locking pin 36 in parallel. It is noted that this dual wire approach consumes more space in the coupler body member 30 as well as necessitating two wires be attached to the coupler. This design may be preferred in larger scale applications or where the coupler arm and body are plastic, as in G scale.

Figure 6A:
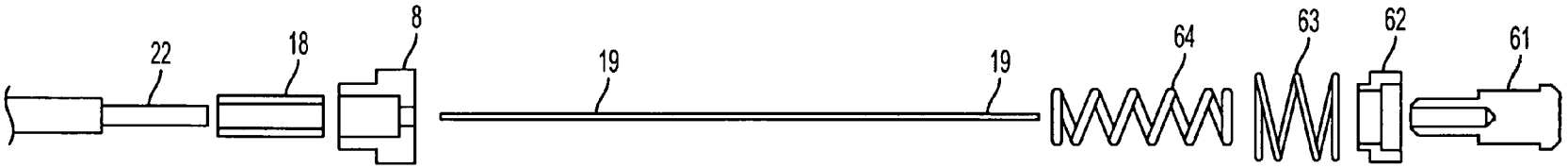
FIG. 6*a* illustrates an exploded view of an exemplary embodiment of the locking pin contained in the coupler of FIG. 1*a*.
Figure 6B:
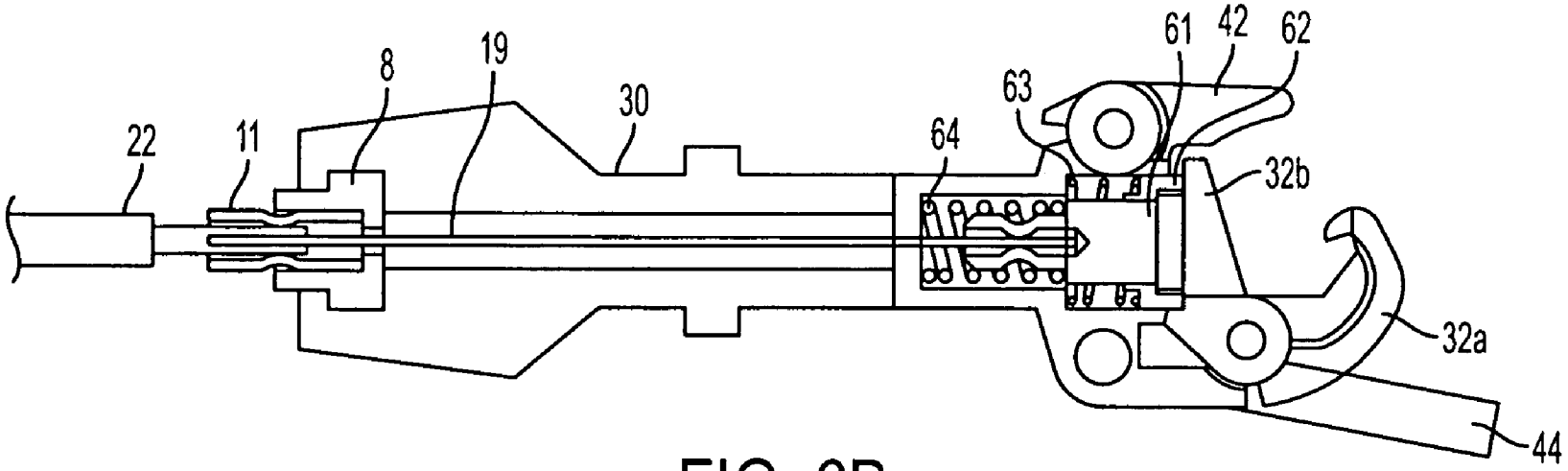
FIGS. 6*b* and FIGS. 6*c* illustrate the position of the locking pin in the latched and open position, respectively.
Figure 6C:
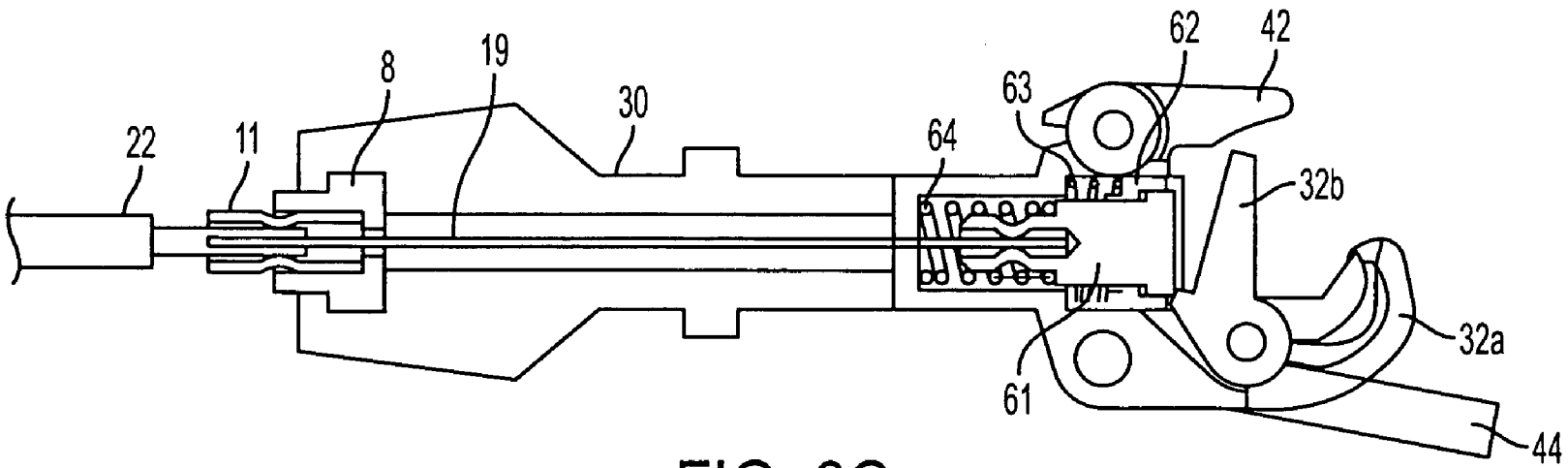

Referring to FIG. 6*a*, which is an exploded view of portion of the coupler, in the given embodiment the locking pin 36 includes an inner tube member 61 to which the memory actuator wire 19 is securely fastened, and an outer sleeve member 62 which travels over the inner tube member. It is the upper edge portion of the outer sleeve member that engages the base section 32*b* of the knuckle 32 and holds the knuckle 32 in the closed position as shown in FIG. 6*b*. During operation, when the memory actuator wire 19 contracts, the inner tube member 61 is pulled away from the knuckle 32. This retraction of the inner tube member 61 also causes the retraction of the outer sleeve member 62 to the extent necessary to allow the knuckle 32 to transition to the open position as shown in FIG. 6*c*. In the given embodiment, the manual activator 44 for releasing the locking pin 36 is configured such that manual activation of the lever for opening the knuckle 32 only slides the outer sleeve member 62 down about the inner tube member 61 sufficiently so as to release the knuckle 32 to the open position. It is noted that the locking pin 36 could also be a single member which retracts when the electrical signal is supplied to the memory actuator wire 19 or the manual release mechanism 44 is activated by the operator. It is further noted that the manual actuator 44 can be activated mechanically or magnetically via a track device, which may include, for example, an electromagnet.

Referring again to FIGS. 4, 5, 6*b* and FIG. 6*c*, which is an cross-sectional view of the coupler taken from a top-down view, as noted above, in the given embodiment, the knuckle 32 is biased toward the open position by means of a spring 12 coiled around the pivot point P of the knuckle. In addition, inner tube member 61 of the locking pin 36 is biased toward the knuckle 32 (i.e., toward the locked position) by a spring 64 disposed within the body member 30, and the outer sleeve member 62 is biased toward the knuckle 32 by a spring 63. Of course, different biasing schemes and different biasing means may be utilized in conjunction with the coupler 100.

With regard to operation and supplying of a control signal (i.e., electrical signal) to the coupler 100 to open the knuckle, as noted, the signal is supplied to the coupler 100 via lead wire 22. The voltage level and duration of the control signal necessary to contract the memory actuator wire 19 and pull back the locking pin 36 a sufficient distance so as to release the locking pin 36 depends on the length and diameter of the wire, and can be readily determined once these variables are defined for the given design. However, typical values of the control signal for use in the coupler would be a pulsed signal having a duration in the range of 100 msec. to 1 sec.; a voltage level in the range of 1.0-5.0 volts, and a current in the range of 0.25-1.0 amps.

The coupler of the present invention provides important advantages over the prior art couplers. Most importantly, the coupler provides for substantial scale accuracy with regard to both size and shape of the coupler, and allows for remote operation of the coupler at any location on the rail system without requiring manual intervention by the operator (i.e., without requiring the operator to physically engage the car being uncoupled).

Another advantage of the coupler of the present invention is that it allows for single-handed release of the car connected to the coupler. In other words, activation of the coupler of the present invention allows the coupler of the present invention to unilaterally release from standard prior art couplers. Typically, model trains also include control of lights, sounds, smoke, motor speed, and a variety of other features. As such, the generation of a control signal that can be supplied to the coupler via the lead wire 22 can readily be made integral with an overall operating system on-board the model train so as to allow the operator open the coupler by simply pressing a single button or programming the control signal to deliver the necessary control signal to the lead wire 22.

Another advantage associated with the present invention is low power operation. Model train layouts are generally powered by transformers with limited output power. In fact, the maximum power output capability is limited by UL and/or CPSC safety regulations. Therefore, power budgets are carefully conserved as operators desire to operate a maximum number of trains and accessories with the minimum wattage power supplies. In the case of the model itself, many include lights, sounds, and smoke, in addition to the fundamental motor drive mechanism. Wherever power can be conserved is a value. The coupler of present invention utilizes less than 10% of the power required to operate traditional coil coupler designs, thereby making the coupler more efficient and cost effective.

Yet another advantage associated with the highly efficient design of the present invention is the ability to operate the coupler at low voltage levels. In most instances, the speed of the model train is determined by the voltage level applied to the track. As voltage is increased, the vehicle moves faster and likewise, as voltage is lowered, the vehicle slows down. A much sought after operating characteristic of model trains is slow speed operation. Prototypically, real trains uncouple cars at very low speeds. When translated to the model train environment, this means low track voltage. The ability for the present invention to operate reliably at low track voltage is a significant advantage over historical remote operating coupler designs requiring high track voltage to energize a solenoid.

Another advantage associated with the present invention is the transferability of the design to alternate scales of model trains and/or other applications within the realm of model railroading. In terms of transferability of the coupler design to other scales, the coupler of the present invention can be scaled up or down to suit the needs of all scales of model trains.

Yet another advantage associated with the coupler is that it provides for "impact closure." Simply stated, this means that if the coupler is open, contacting another coupler aligned on the track will cause the knuckle to close and latch. Thus, the coupler provides the model railroader the means of remotely releasing cars as well as connecting to them in a very prototypical fashion. Upon impact, the knuckle contacts the mating coupler first. The contact causes the knuckle to pivot closed. When in the closed position, the spring loaded locking pin automatically engages and locks the knuckle in the closed position. The coupler of the present invention also allows for a delayed uncoupling operation.

Another advantage of the present invention as already noted is that it provides for single sided release. This is especially advantageous for HO-scale model trains. Prior to the instant invention, in coupler designs commonly found in the HO market, it is necessary to release both couplers to attain separation of two vehicles. In other words, opening only one coupler does not necessarily accomplish the objective of disconnecting two vehicles. In contrast, the coupler of the present invention allows for single-sided release.

Although certain specific embodiments of the present invention have been disclosed, it is noted that the present invention may be embodied in other forms without departing from the spirit or essential characteristics thereof. The present embodiments are therefore to be considered in all respects as illustrative and not restrictive, the scope of the invention being indicated by the appended claims, and all changes that come within the meaning and range of equivalency of the claims are therefore intended to be embraced therein.

We claim:

1. A coupler for use with model trains, said coupler comprising:

a body member;

a knuckle pivotally mounted on said body member, said knuckle being in either an open state or a closed state;

a coupler guide disposed on said body member; and a locking pin disposed within said body member, said locking pin operable for maintaining said knuckle in said closed state when said locking pin is in a first position, and for allowing said knuckle to transition to said open state when said locking pin is in a second position;

wherein when said knuckle is in said open state said coupler guide prevents said knuckle from engaging a knuckle of a second coupler to be uncoupled from said coupler, and wherein when said knuckle is in the open state, said knuckle is pivoted such that said coupler guide extends into a throat area defined by said coupler by a distance which is greater than the distance a latch member of said knuckle extends into said throat area.

2. The coupler according to claim 1, wherein coupler further includes a first spring member which operates to bias said knuckle toward the open state.

3. The coupler of claim 2, wherein said coupler further includes a second spring member which operates to bias said locking pin toward the first position.

4. The coupler according to claim 1, wherein said knuckle further includes a base section, said locking pin engaging said base section when said knuckle is in the closed state so as to prevent said knuckle from transitioning to the open state.

5. The coupler according to claim 1, wherein said coupler further includes an actuator wire coupled to said body member and said locking pin, said actuator wire contracting in length when an electrical signal is supplied thereto, said locking pin being transitioned to said second position when said signal is supplied to said actuator wire.

6. The coupler according to claim 5, further comprising a manual actuator coupled to said locking pin, said locking pin being transitioned to said second position when said manual actuator is operated by a user.

7. The coupler of claim 1, further comprising a knuckle stop member pivotally mounted on the body member, said knuckle stop member operable for engaging said knuckle of said second coupler into a throat area defined by said coupler.

8. A coupler for use with model trains, said coupler comprising:

a body member;

a knuckle pivotally mounted on said body member, said knuckle being in either an open state or a closed state;

a locking pin disposed within said body member, said locking pin operable for maintaining said knuckle in said closed state when said locking pin is in a first position, and for allowing said knuckle to transition to said open state when said locking pin is in a second position; and an actuator wire coupled to said body member and said locking pin, said actuator wire contracting in length when an electrical signal is supplied thereto, said locking pin being transitioned to said second position when said electrical signal is supplied to said actuator wire, wherein when said knuckle is in the open state, said knuckle is pivoted such that a coupler guide extends into a throat area defined by said coupler by a distance which is greater than the distance a latch member of said knuckle extends into said throat area.

9. The coupler according to claim 8, wherein said actuator wire returns to its non-contracted length when said electrical signal is removed from said actuator wire.

10. The coupler according to claim 9, further comprising a lead wire coupled to said actuator wire, said electrical signal delivered to said actuator wire via said lead wire.

11. The coupler according to claim 8, wherein coupler further includes a first spring member which operates to bias said knuckle toward the open state.

12. The coupler according to claim 8, wherein said knuckle further includes a base section, said locking pin engaging said base section when said knuckle is in the closed state so as to prevent said knuckle from transitioning to the open state.

13. The coupler according to claim 8, further comprising a manual actuator coupled to said locking pin, said locking pin being transitioned to said second position when said manual actuator is operated by a user.

14. The coupler of claim 8, wherein said coupler further includes a second spring member which operates to bias said locking pin toward the first position.

15. The coupler of claim 8, further comprising a knuckle stop member pivotally mounted on the body member, said knuckle stop member operable for engaging said knuckle of said second coupler into a throat area defined by said coupler.

16. A coupler for use with model trains, said coupler comprising:

a body member;

a knuckle pivotally mounted on said body member, said knuckle being in either an open state or a closed state;

a locking pin disposed within said body member, said locking pin operable for maintaining said knuckle in said closed state when said locking pin is in a first position, and for allowing said knuckle to transition to said open state when said locking pin is in a second position;

an actuator wire coupled to said body member and said locking pin, said actuator wire contracting in length when an electrical signal is supplied thereto, said locking pin being transitioned to said second position when said electrical signal is supplied to said actuator wire, a tubular member for coupling said actuator wire to a lead wire, said lead wire providing said electrical signal to said actuator wire, said tubular member disposed within said body member, and an insulating member disposed around said tubular member so as to electrically isolate said tubular member from said body member.

17. A coupler for use with model trains, said coupler comprising:

a body member;

a knuckle pivotally mounted on said body member, said knuckle being in either an open state or a closed state;

a locking pin disposed within said body member, said locking pin being movable within said body member and operable for maintaining said knuckle in said closed state when said locking pin is in a first position, and for allowing said knuckle to transition to said open state when said locking pin is in a second position;

an actuator wire coupled to said body member and said locking pin, said actuator wire being disposed within said body member and contracting in length when an electrical signal is supplied thereto, said locking pin being transitioned to said second position when said electrical signal is supplied to said actuator wire, and a tubular member for coupling said actuator wire to a lead wire, said lead wire providing said electrical signal to said actuator wire, said tubular member disposed within said body member, wherein said locking pin is biased so as to be in said first position when said electrical signal is not supplied to said actuator wire.

18. The coupler of claim 17, further comprising a spring member disposed within said body member for biasing said locking pin in the direction of said first position.

19. The coupler of claim 18, wherein said locking pin is retracted against the bias of said spring member so as to move within said body member in the direction of said tubular member when said electrical signal is applied to said actuator wire.

20. The coupler of claim 17, wherein said locking pin is formed by an inner tube member and an outer sleeve member, both said inner tube member and said outer sleeve member being biased in a direction away from said tubular member, said inner tube member operates to retract said outer sleeve member when said electrical signal is applied to said actuator wire.

21. The coupler of claim 20, wherein said inner tube member moves within an opening formed in said outer sleeve member.

22. The coupler of claim 20, wherein said outer sleeve member contacts said knuckle when said knuckle is in said closed state.

* * * * *